United States Patent [19]

Zdanys, Jr.

[11] 4,326,110

[45] Apr. 20, 1982

[54] PREPROGRAMMED SLIDE SWITCH ASSEMBLY

[75] Inventor: John Zdanys, Jr., Edwardsburg, Mich.

[73] Assignee: CTS Corporation, Elkhart, Ind.

[21] Appl. No.: 186,912

[22] Filed: Sep. 15, 1980

[51] Int. Cl.[3] ..... H01H 15/00

[52] U.S. Cl. ..... 200/16 R; 200/16 C; 200/16 D; 200/291; 200/303

[58] Field of Search ..... 200/6 R, 6 B, 6 BA, 200/6 BB, 16 R, 16 C, 16 D, 16 E, 16 F, 291, 243, 303

[56] References Cited

U.S. PATENT DOCUMENTS

| | | | |
|---|---|---|---|
| 3,485,966 | 12/1969 | Bailey et al. | 200/16 D |
| 3,858,012 | 12/1974 | Lockard | 200/16 D |
| 3,944,760 | 3/1976 | Zdanys et al. | 200/6 BB |
| 3,947,391 | 3/1976 | Lutzenberger | 200/16 D |
| 4,122,317 | 10/1978 | Shimamune et al. | 200/16 F |
| 4,168,404 | 9/1979 | Lockard | 200/16 D X |

*Primary Examiner*—James R. Scott

*Attorney, Agent, or Firm*—Larry J. Palguta; John A. Young

[57] ABSTRACT

A preprogrammed slide switch assembly (10) is provided for the simultaneous opening or closing of a series of switches disposed within a housing (12). A slider (60) having a grip (66) extending through an longitudinal opening (14) in the housing (12), has a plurality of contactor bars (54) attached thereto and extending laterally, each in a predetermined direction. A two part base (22) has each part (24, 26) molded about a plurality of terminals (28) so that when the parts (24, 26) are coupled together, pairs of oppositely disposed terminals (28) will each be positioned for engagement with a respective one of the lateral contactor bars (54). The lateral contactor bars (54) engage either one or both of the terminals (28) of the respective set of terminals in one of two transverse positions of the slider (60), and in a predetermined pattern of open and closed switches. Transverse movement of the slider (60) effects either on opening or a closing of each of the sets of terminals (28) in a predetermined switching pattern.

11 Claims, 7 Drawing Figures

PREPROGRAMMED SLIDE SWITCH ASSEMBLY

DESCRIPTION

1. Technical Field

The preprogrammed slide switch relates to miniature dip switches utilized for computer controls, telecommunication controls, and other electronic equipment. The electronic and communication systems have calibration and inspection circuits requiring that certain multiple inputs be disabled while calibration or comparator inputs are applied to the system. The preprogrammed dip switch may be utilized for the predetermined disabling of those multiple circuits during calibration or comparator input application.

2. Background Art

Electronic and communication systems often are equipped with calibration or comparator circuits which require the disabling of certain multiple inputs while calibration or comparator inputs are applied to the system. This is done to determine if the system is operating properly, and the procedure requires that multiple connections be opened or closed in a particular pattern each time the calibration operation is performed. This is a time consuming operation prone to error when a multiplicity of individual switches are involved, and leads to a similar problem when all of the switches are returned to the "run" position.

Miniature DIP (dual-in-line pole) switches are well-known within the art. Such switches are described in Shimamune et al. U.S. Pat. No. 4,122,317 issued on Oct. 24, 1978, and Zdanys et al. U.S. Pat. No. 3,944,760, issued on Mar. 16, 1976 and assigned to the same assignee herein. Each of these multicircuit DIP switches comprise constructions which effect a selective individual switching of multiple circuits. Both the Shimamune and Zdanys constructions consist of a multiplicity of sliders for opening and closing each individual circuit in any given pattern and in any given sequence. It is precisely this individual switching of each circuit which can cause the errors described above. Therefore, for the purpose of performing a calibration operation of the electronic or communications system, it would be necessary to position each individual switch within the various DIP switch packages in a precise and predetermined pattern in order to disable the circuits in proper sequence for the subsequent provision of calibration inputs.

The preprogrammed DIP switch concept solves this problem by providing a means for simultaneously switching four to ten circuits in a predetermined "on-off" pattern. This is accomplished by moving the single slider to one or the other of the two possible positions. Thus, a plurality of DIP switch packages can be quickly, and most importantly, accurately switched to positions which disable multiple inputs for the application of the calibration inputs.

DISCLOSURE OF THE INVENTION

The preprogrammed DIP slide switch assembly comprises a cover housing having a longitudinal opening in the top surface and a two part base fittable within said cover. A plurality of terminals are disposed within each part of the base to form sets of oppositely disposed terminals. A slider includes a grip projecting through the opening in the housing and has a plurality of depending posts for slideable engagement with the top surface of the base. Disposed between said posts and secured to the bottom of the slider, are a plurality of contactors which have been blanked in a predetermined pattern. Before mounting, the contactors were part of a base strip having contactors projecting laterally from both sides. The base strip was first blanked in a universal pattern and then formed to have contactors extend from the strip in a predetermined pattern. The contactors are each received within a respective recess slot in the slider, the slots maintaining the contactors in position. The slider is positioned over and about the sets of oppositely disposed terminals so that each of said contactors engages at least one of a set of terminals, some of said contactors contacting both of the terminals for completing a circuit thereacross. When the slider is moved transversely, each contactor slideably engages or disengages its respective set of terminals to make or break the circuit across the terminals. The contactors, having been blanked in predetermined combinations, thus cause the switches of the DIP switch package to be in open or closed positions in predetermined patterns according to the lateral position of the slider. Thus, the simultaneous switching of four to ten circuits can be accomplished in a predetermined "on-off" pattern simply by moving the slider to one of the two lateral positions.

BEST MODE FOR CARRYING OUT THE INVENTION

Figure 1:
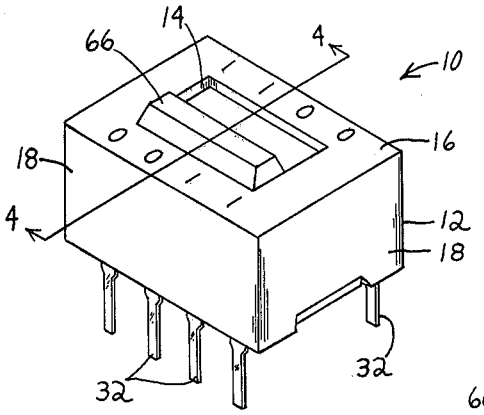
FIG. 1 is an isometric view of the preprogrammed DIP slide switch of the present invention.
Figure 2:
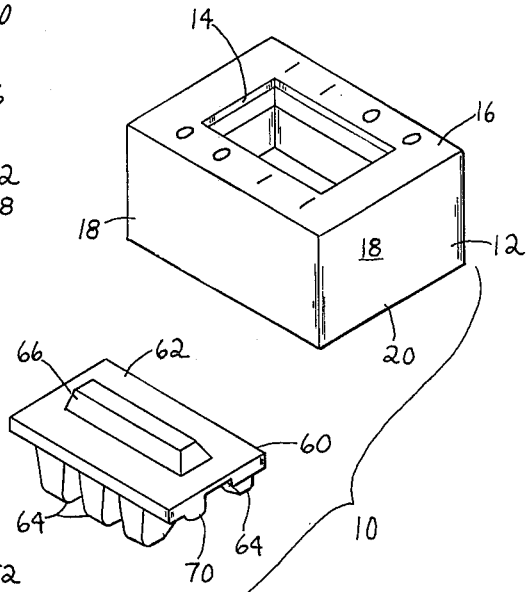
FIG. 2 is an exploded isometric view of the switch shown in FIG. 1.
Figure 2:
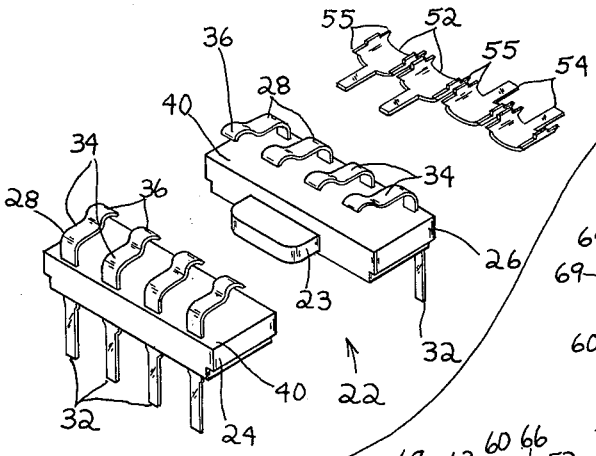
Figure 4:
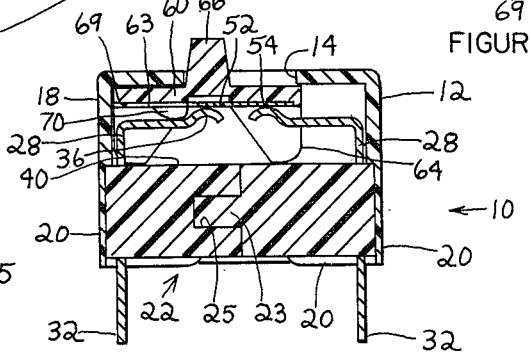
FIG. 4 is a section view along the lines 4—4 of FIG. 1.

Referring now to the drawings, FIGS. 1 and 2, the preprogrammed DIP slide switch assembly is designated generally by reference numeral 10. The switch assembly 10 comprises a housing 12 having a longitudinal opening 14 in the top surface 16, and includes sides 18. The sides 18 each have an extension 20 for receiving a base designated generally by reference numeral 22. The base 22 comprises two base rails 24, 26 consisting of a thermoset material such as a phenolic. Each of the base rails 24, 26 is insert molded about a plurality of terminals 28, the terminals being preferably a gold plated brass strip. As shown in FIGS. 2 and 4, the base rail 26 has a tongue 23 and base rail 24 has an oppositely disposed slot 25, the base rails being manufactured such that they may be readily assembled together to form the base 22. Once assembled, the perimeter of the base 22 fits within the extensions 20 of the housing 12 and thereby enclosing the bottom portion of the switch 10.

Each terminal 28 includes a terminal extension 32 extending from the bottom surface of the base rail for connection to an external circuit, and a terminal arm 34 and terminal head 36 extending from the top surface of the respective base rail. The terminal arm 34 extends upwardly from the base rail surfaces 40 and then extends laterally towards the opposing terminal in a cantilevered manner. The end of each terminal arm 34 is formed into a terminal head 36 for effecting slideable engagement with a contactor to be hereinafter described. After the base rails 24, 26 have been assembled, each terminal 28 faces an opposing terminal 28 disposed in the opposite base rail, to form sets of terminals comprising oppositely disposed terminals.

Figure 2A:
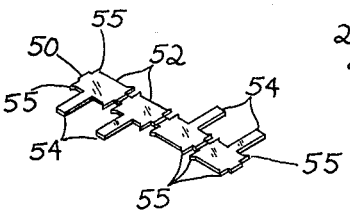
FIG. 2A is an isometric view of a blanked contactor strip having a preprogrammed pattern.

Referring now to FIG. 2A, the contactor strip 50 comprises a longitudinal blanked strip of gold plated brass including base bars 52, barbs 55, and contactor bars 54 sheared in a predetermined "on-off" pattern as hereinafter explained, that is, in a pattern wherein the contactor bars 54 extend from a predetermined side of each base bar 52. As shown in FIG. 2A, the strip 50 has two contactor bars 54 extending from the right side and two contactor bars extending from the left side thereof. This predetermined pattern will determine the preprogrammed on-off switching accomplished by the switch 10. The strip 50 is manufactured to be easily secured to a slider 60. The slider 60 comprises a generally rectangular base 62 having depending support posts 64 extending from one side thereof and a grip 66 extending from a top surface of the base 62. The grip 66 will extend through the longitudinal slot 14 for actuation of the switch.

Figure 5:
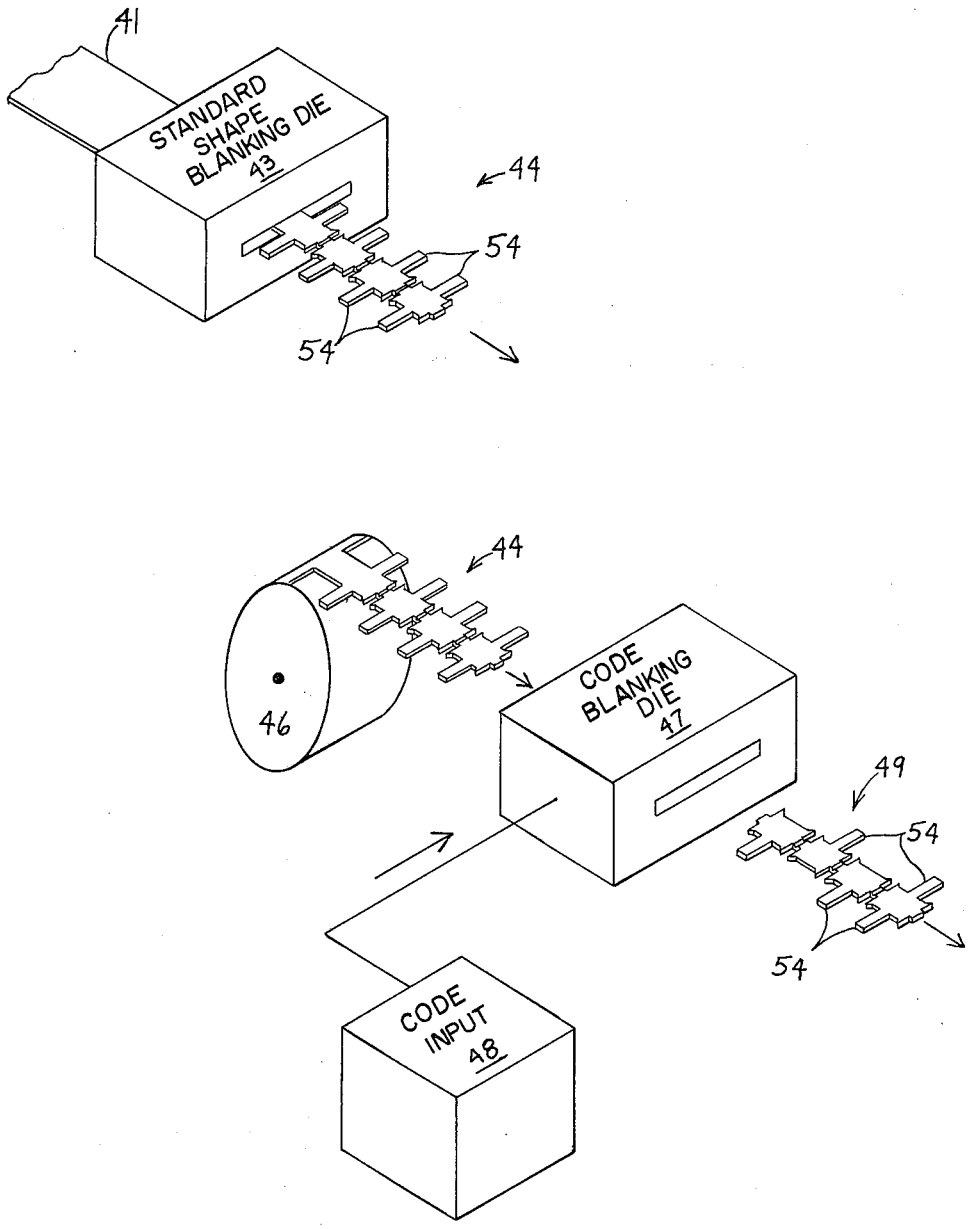
FIG. 5 is a schematic illustration of a method for manufacturing a contactor strip by the coded blanking of a universal or standard blanked contactor strip; and, FIG. 6 is a schematic illustration of four preprogrammed switching patterns.

Referring now to FIG. 5, illustrated therein are the steps for manufacturing contactor strips 50 having a predetermined pattern. A brass flat stock 41 is supplied to a standard shape blanking die 43 which blanks a universal contactor strip designated generally by reference numeral 44, the strip having contactor bars 54 extending from both sides. The universal contactor strip 44 is fed from reel 46 to the code blanking die 47 which is responsive operatively to code input unit 48. A code for the particular pattern desired is transmitted to the blanking die 47 which performs the functions of shearing the strip 44 to produce the number of switches required and shearing the appropriate contactor bars 54 in accordance with the coded input to produce the selected pattern. Thus, the contactor strip 49 is produced by the code blanking die 47 and is ready for subsequent securement to the slider 60. As can readily be seen, such a manufacturing process can inexpensively produce any of the large number of predetermined switching patterns that can be selected for preprogrammed slide switch assemblies having two to ten switches.

Figure 3:
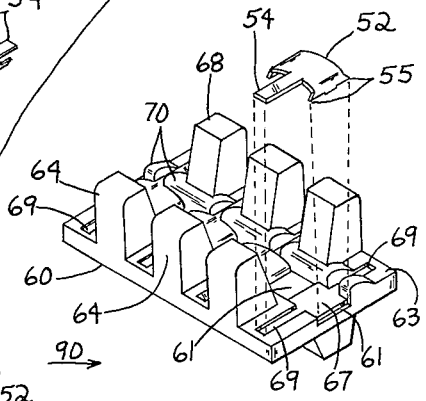
FIG. 3 is a perspective view of the contactors mounted upon the bottom side of the slider.

Referring now to FIG. 3, the slider 60 is shown in an inverted position in order to better illustrate the mounting of the strip 50 thereon. Each support post 64 has a bearing surface 68 for slideable bearing engagement with a surface 40 of the base 22. The formed contactor strip 50 is secured to the slider 60 by positioning the strip 50 along the bottom surface 63 and then force staking the base bars 52. A plurality of slider cavities 61 are disposed in aligned relationship along the surface 63, each cavity separated by a slider wall 67. The strip 50 is positioned along the surface 63 with the junction of each base bar 52 being positioned over a cavity 61. A staking tool then forces the junction of each bar 52 into a cavity by first breaking the bases apart one from the other and then the barbs 55 in each bar 52 bite into the walls of the cavity, during which each bar 52 is bent over the wall 67, thereby securing each base bar 52 and associated contactor bar 54 to the slider 60 as shown in FIG. 3. After mounting, the bars 52 are arcuately shaped, however the contactor bars 54 are still of a generally planar configuration. Also disposed in the slider 60 are recess slots 69 extending transversely across the surface 63. Each recess slot 69 is disposed to receive a contactor bar 54. The predetermined pattern of contactor bars 54 fits into the respective recess slots 69, the recessed slots 69 capturing and maintaining each bar 54 so that it will not move therefrom. Each recess slot 69 is of a minimum depth such that once the respective bar 54 is disposed therein, a portion of the bar will still be exposed above the surface 63. The width of recess slot 69 is made narrower than contactor terminal head 36 to provide a bearing surface for terminal head 36 to ride on at the positions where contactor bars 54 are missing. Also located upon the surface 63 are aligned cams 70.

The switch 10 is assembled in the form illustrated in FIGS. 1 and 4. The slider 60 is positioned over and about the terminals 28 protruding from the base 22, each bearing surface 68 being able to contact a surface 40. The grip 66 extends through and beyond the longitudinal slot 14 in the housing 12, and in one of the two switch positions is disposed at one side of the slot as shown in FIG. 4. The housing extensions 20 receive the perimeter of the base 22 to enclose the interior cavity of the housing 12. The extensions 20 may be heat staked against the base 22 to secure the base to the housing; as shown in FIGS. 1 and 4. As shown in FIG. 4, the contactor bars 54 disposed along the side 63 of the slider 60 are positioned above and adjacent to the terminal heads 36, each bar 54 being in contact with at least one of its respective set of terminals 28. Depending on the predetermined "on-off" pattern, a contactor bar 54 will engage either one terminal head or both terminal heads 36 in a given position. Each cam 70 bears against one side of a terminal head 36, depending on the relative transverse position of the slider 60. In FIG. 4, the cam 70 bears against the left or back side of terminal head 36, and when the slider 60 is positioned transversely to the right, the cam 70 will have moved over the head 36 and be positioned on the other side of the head. The purpose of the cam 70 is to prevent accidental movement of the slider 60 and to provide a positive detent feel as the slider is moved.

Operation

The preprogrammed DIP switch 10 is essentially a two position "on-off" switch capable of the simultaneous switching of as many as ten circuits in a predetermined on-off pattern. As illustrated in FIG. 4, the particular set of terminals 28 shown therein have an associated contactor bar 54 which engages the terminal heads 36 when the slider is positioned at the left side of the slot 14. The terminals 28 are resiliently cantilevered so that when the slider 60 is positioned thereover and the housing 12 is positioned over the slider 60, the slider 60 is forced downwardly by the housing 12 until the bearing surfaces 68 engage the surfaces 40, the terminal heads 36 being resiliently biased against their respective contactor bars 54. An external circuit (not shown) connected to the terminals 32 is a closed circuit because the contactor bar 54 shunts the terminals 28 in FIG. 4. When the slider 60 is moved to the right in direction of arrow 90, the user first feels a resistance because the cam 70 is bearing against the resiliently cantilevered terminal head 36, and that force must be overcome by the cam forcing the terminal head downwardly. As the user moves the slider 60 to the right, the cam 70 slides over the terminal head 36 and is disposed on the right side of the terminal head 36 when the transverse lateral movement of the slider 60 is completed. When the slider 60 is located to the right side of slot 14, the contactor bar 54 no longer acts as a shunt across the terminal heads 36 to complete a circuit across the terminals 32. Thus, the circuits across the respective sets of terminals 32 may be closed or opened depending upon the orientation of the contactor bars 54 and slider 60. The orientation or positioning of the contactor bars 54 is determined by the blanking of the predetermined pattern of the bars i.e., that is, the bars 54 are formed on one side or the other of each base bar 52. This operation is performed on the universal strip 44 which provided bars 54 on both sides of base bar 52, as previously described and shown in FIG. 5.

As can be seen from the housing 12 illustrated in FIGS. 1 and 2, the housing can indicate thereon the pattern of "on-off" switching as respects the lateral position of the slider 60. The slider 60 effects a gang or multiple simultaneous switching of the DIP switch assembly 10, regardless of the number of sets of switches contained within the particular DIP switch assembly. This preprogrammed pattern of "on-off" switching has applicability for electronics and communications systems which require timely calibration operation. The particular system as a whole, is calibrated according to particular voltage values which determine that the components of the system are operating as designed. Periodically during the operating of the system, it is necessary for serviceman or technicians to check the individual circuits or the entire system to determine if the circuit or system is operating as it was initially set up to operate. This is done by disabling the circuits in certain patterns and then providing a calibration input to determine if the system is operating appropriately. Thus, the technician or serviceman may simply adjust each preprogrammed DIP switch assembly 10 by moving the respective slider from its "run" position to the calibration position, thereby disabling certain multiple inputs while calibration or comparator inputs are applied to the system. Utilization of a preprogrammed DIP switch in electronic and communications systems for use in conjunction with calibration comparator checking, can eliminate the multiplicity of errors that can occur when a technician must change the orientation of a multiplicity of singularly operated switches.

It is an important feature of the present invention that the slider and contactor strip construction enables a purchaser to specify literally a limitless variety of switch programs for a very minimal tooling charge for each program. This results directly from producing the predetermined or desired pattern by simply blanking the universal contactor strip so that the contactor bars 54 have an orientation corresponding to the appropriate predetermined pattern. This quite obviously results in maximum circuit design flexibility at a minimum additional expense for the purchaser.

Figure 6:
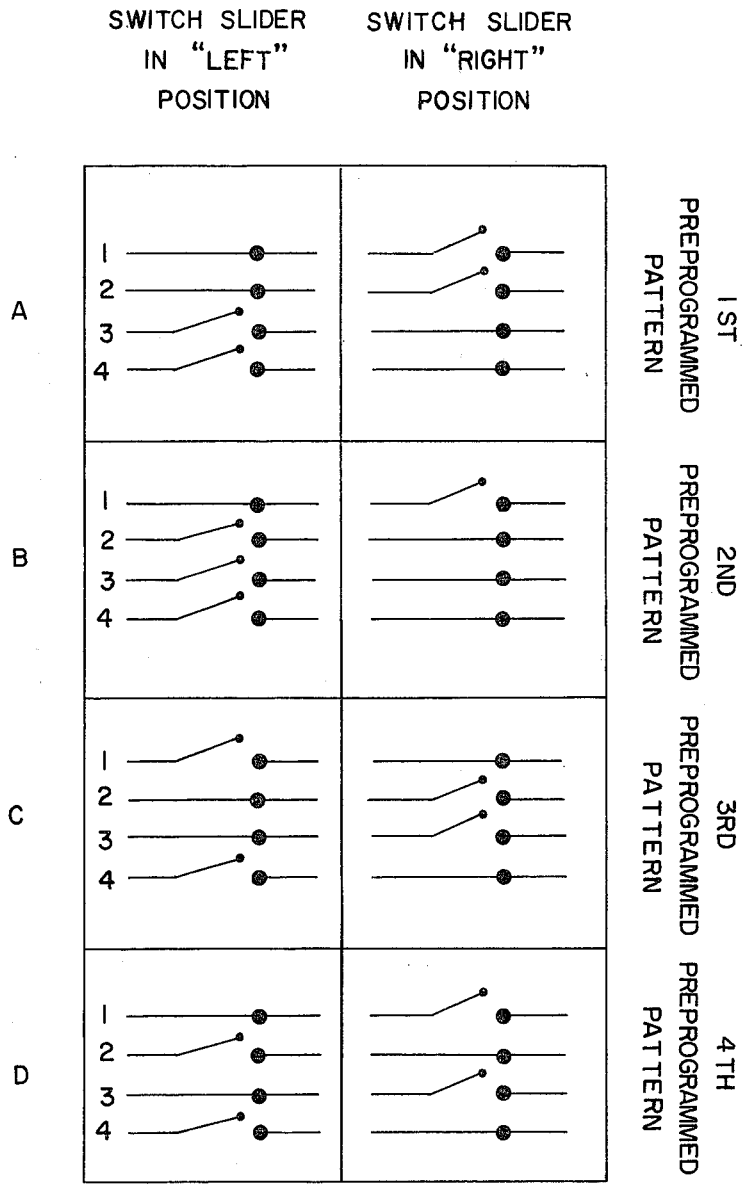

Referring now to FIG. 6, illustrated schematically therein are four distinct preprogrammed on-off switching patterns which may be selected for a preprogrammed DIP switch having four sets of terminals. FIG. 6A illustrates a preprogrammed on-off pattern wherein switches 1 and 2 are in a closed position and switches 3 and 4 are in an open position when the slider is positioned to the left of the transverse slot 14. When the slider is moved to the right, switches 1 and 2 are opened and switches 3 and 4 are closed. FIGS. 6B, C, and D illustrate other preprogrammed patterns that can be selected for simultaneously switching the four circuits in various predetermined on-off patterns. Thus, a preprogrammed DIP slide switch assembly having four sets of terminals can be preprogrammed for the simultaneous switching of four circuits in twenty four (24) different predetermined on-off patterns. Obviously, the greater the number of contacts (up to 10), the greater the number of possible programming combinations that can be selected.

Another programming feature of this design is its capability to provide closed contacts in both lateral slider positions. In other words, a base bar 52 may be blanked such that a contactor bar 54 extends from both sides (see FIG. 5). A possible application of this feature would be to provide a momentary break in a common ground line while the other circuits are being switched.

Thus, the preprogrammed DIP slide switch combines the characteristics of maximum circuit design flexibility, minimum cost for preprogrammed circuit patterns, simplicity of design, and a minimal number of parts required for the construction thereof. Combined, these features provide an inexpensive yet reliable solution to repetitive, complex switching routines.

Industrial Applicability

The present invention may be used in conjunction with the many calibration and inspection circuits found in electronic and communications systems.

Conclusion

Although the present invention has been illustrated and described in connection with example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A slide switch comprising a cover having a plurality of walls forming a cavity therein, a plurality of sets of terminals disposed in said cavity, each terminal of said sets of terminals comprising a contact arm integral with a terminal portion extending exterior to the cavity, a transversely movable slider disposed within said cavity, a plurality of cams disposed along one side of said slider and each of said terminals having a curved portion at an end thereof, each of said cams slideably engaging a respective one of said curved portions upon transverse movement of said slider for effecting a detent during said movement, a plurality of contactors secured to said slider, each of said contactors positioned adjacent a set of said terminals, said contactors being disposed in a predetermined pattern whereby at one position each of said contactors effects contacting with a preselected terminal of a respective set of terminals and thereafter at a second position each contactor contacts both terminals of a respective set of terminals whereby upon transverse movement of said slider each of said contactors either effects wipeable engagement with the other terminal of said set of terminals to complete a circuit across said set of terminals or wipeably disengages one terminal of said set of terminals to open a circuit across the set of terminals in a predetermined pattern for making and opening circuits across respective sets of said terminals.

2. The switch in accordance with claim 1, further comprising a grip integral with said slider and means forming a longitudinal opening in said cover, said grip proportioned to extend through said longitudinal opening for accessible actuation to effect transverse movement of said slider.

3. The slide switch in accordance with claim 1, further comprising a base fittable within said cover, each of said sets of terminals fixedly secured to said base.

4. The switch in accordance with claim 1, further comprising a plurality of support posts integral with said slider and each having a bearing surface thereon, and a base, said support posts positioned upon a surface of said base and said bearing surfaces slideably engaging said surface during said transverse movement of said slider.

5. The switch in accordance with claim 1, further comprising a plurality of recess slots disposed in said slider, each of said recess slots receiving and maintaining a respective one of said contactors.

6. A process for opening and closing a plurality of switches in a predetermined pattern, comprising the steps of: disposing a plurality of contactor bars adjacent to a plurality of sets of oppositely disposed terminals and each of said contactor bars in contact with at least one of said oppositely disposed terminals in accordance with said predetermined pattern, moving a slider having said contactor bars secured thereto transversely for effecting slideable engagement between each of said contactors and the respective sets of oppositely disposed terminals whereby each of said contactors effects first a closing and then an opening of a circuit across said terminals in said predetermined pattern, and disposing a plurality of cams each adjacent a terminal head of each of said sets of oppositely disposed terminals whereby said transverse movement of said slider effects a positive detent feel as said slider is moved from one switching position to another switching position.

7. The process in accordance with claim 6, further comprising the step of disposing said contactors above each of said terminals of said sets of oppositely disposed terminals whereby the resilience of said terminals biases said slider into positioning engagement with a cover.

8. A process for providing a preselected set of slide switch controlled multiple circuits, comprising the steps of: providing a preselected number of sets of coacting switching elements, locating a contactor bar in relation to each of said sets of switch elements and in a preselected pattern whereby selected sets are made effective in accordance with a slider position, disposing a plurality of cams each adjacent a curved portion of a respective switching element of said sets whereby transverse movement of the slider of said slide switch effects a positive detent feel as said slider is moved from one switch position to another switch position, the switching of said multiple circuits accomplished by the conjoint locating of said bars in a first position in which a selected number and pattern of switches are made effective to make a combination of circuits in relation to electrically controlled equipment, and thereafter conjointly moving said contactor bars by said slider into a second position in which a distinctly different pattern and number of switches are made effective to make a second combination of circutis in relation to the electrically controlled equipment.

9. The process in accordance with claim 8, in which the selected number of effective sets of switching elements for the electrically controlled equipment is constructible from and limited only by the total number, combination, and pattern of the contactor bars in relation to their associated switching elements.

10. The slide switch in accordance with claim 3, wherein the base is insert molded about said terminals to fixedly secure said terminals.

11. The process in accordance with claim 6, further comprising the step of insert molding a base portion about aligned terminals of said sets of oppositely disposed terminals.

* * * * *